United States Patent [19]

Arfert

[11] 3,979,015

[45] Sept. 7, 1976

[54] CONTAINER

[75] Inventor: Horst F. W. Arfert, Richmond, Va.

[73] Assignee: Reynolds Metals Company, Richmond, Va.

[22] Filed: Dec. 20, 1974

[21] Appl. No.: 534,721

[52] U.S. Cl. ..... 220/307; 220/231; 220/281; 220/308

[51] Int. Cl.[2] ..... B65D 43/10

[58] Field of Search ..... 220/306, 307, 213, 231, 220/281, 308, 309, 310; 215/301

[56] References Cited

UNITED STATES PATENTS

| | | | |
|---|---|---|---|
| 3,204,813 | 9/1965 | McCuskey et al. | 220/306 |
| 3,612,342 | 10/1971 | Rathbun | 220/306 |
| 3,627,170 | 12/1971 | Pulliam | 220/306 |
| 3,679,088 | 7/1972 | Swett et al. | 220/306 |
| 3,753,512 | 8/1973 | Curry | 220/306 |
| 3,895,736 | 7/1975 | Swett | 220/306 |

*Primary Examiner*—William Price
*Assistant Examiner*—Joseph M. Moy
*Attorney, Agent, or Firm*—Glenn, Lyne, Gibbs and Clark

[57] ABSTRACT

A container is provided having a body adapted to contain a product therein and having a bottom wall and a side wall which terminates in a first circumferential bead defining an open end in the body. A closure is provided for the body and such closure has a main portion adjoined at its outer edge by an annular flange with the annular flange terminating in a second circumferential bead; and an annular indentation is provided in the flange and first bead which cooperates with seal means for the closure to provide an improved seal between the closure and the first annular bead.

15 Claims, 20 Drawing Figures

CONTAINER

BACKGROUND OF THE INVENTION

There are numerous containers in current use, such as containers made of light gauge aluminum alloys which are used to contain various products including food products. For example, puddings, gelatin desserts, fruits, and the like are often sold in such a container which is sized to provide one normal serving and such a container is then used as a serving dish whereby a consumer is encouraged to eat therefrom using an appropriate eating implement and/or drink directly therefrom.

A serious problem with these types of containers in current use is that the lid or closure provided on such a container usually cannot be removed easily without damage to the container and the leaving of jagged metal edges which are very dangerous.

SUMMARY

This invention provides a simple and economical nestable container which is particularly adapted to be made of a light gauge metallic material, such as aluminum, or the like, and which has a closure which assures sealing a product carried within such container with minimum likelihood of spoilage yet such closure is readily removed without the likelihood of producing jagged edges which could injure a consumer.

The container comprises a container body adapted to contain a product therein and having a bottom wall and a side wall terminating in a first circumferential bead defining an open end in the container body. The container has a closure for the container body with the closure having a main body portion adjoined at its outer edge by an annular flange with the flange terminating in a second circumferential bead. Seal means is provided between the closure and first bead, and an annular indentation is provided in the flange and first bead which cooperates with the seal means to provide an improved seal between the closure and the first annular bead.

Other details, uses, and advantages of this invention will be readily apparent from the exemplary embodiment thereof presented in the following specification, claims, and drawings.

BRIEF DESCRIPTION OF THE DRAWINGS

The accompanying drawings show present exemplary embodiments of this invention, in which.

DESCRIPTION OF ILLUSTRATED EMBODIMENTS

Figure 1:
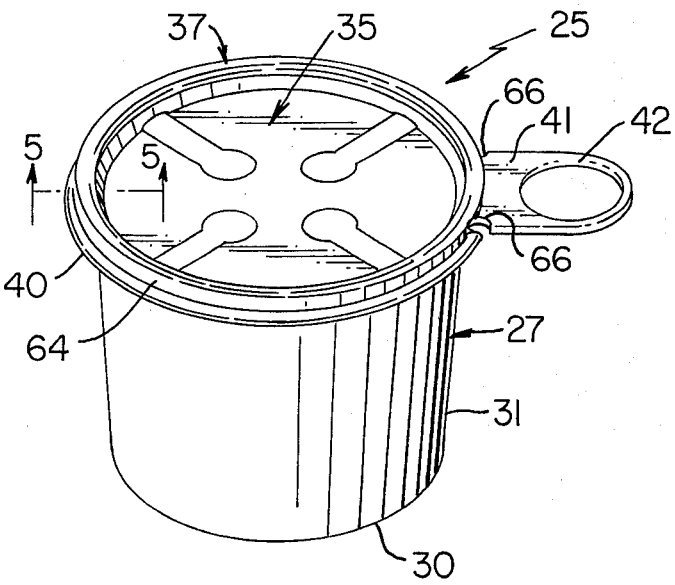
FIG. 1 is a perspective view of one exemplary embodiment of the container of this invention which has a closure sealed on the container body thereof and with a product contained therewithin.

Reference is now made to FIG. 1 of the drawings which illustrates one exemplary embodiment of the container of this invention which is designated generally by the reference numeral 25 and such container is particularly adapted to contain a product, such as a food product 26, which may be a normal serving of a dessert such as a pudding, gelatin, fruit, or the like whereby the container 25 usually has about a 5 ounce capacity for this purpose. The container 25 comprises a container body 27 (also see FIG. 2) which has a bottom wall 30 and a side wall 31 which terminates in a first circumferential bead 32 defining an open end 33 in the container body 27.

The side wall 31 is substantially frustoconical and has a radially outwardly offset top portion 34 which is of limited vertical height and is also substantially frustoconical and the portion 34 is interconnected to the top edge of the main part of the side wall 31 by a substantially horizontally extending radial flange 28; and, the circumferential bead 32 is provided at the top edge of the outwardly offset portion 34 and will be described hereinafter as terminating at the top edge of the side wall 31 whereby the container body 27 is completely nestable and easily processed by automatic handling equipment.

The container 25 has a closure 35 for the container body and such closure has a central or main body portion adjoined at its outer edge by an annular flange 37 and the flange 37 terminates at its peripheral outer edge in a second circumferential bead 40. The construction and arrangement of the flange 37 will be described in detail subsequently.

The closure 35 also has a pull device 41 extending from the peripheral outer edge of its flange 37 and provided as an integral part of such flange, and although the pull device may be of any suitable type in this example such pull device is in the form of a pull ring 41 having a finger receiving opening 42 therein.

Figure 4:
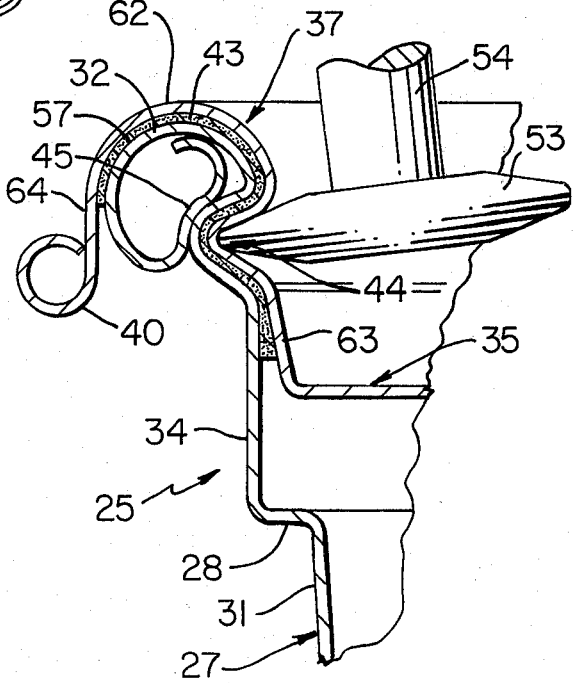
FIg. 4 is an enlarged cross-sectional view similar to FIG. 3 illustrating one technique which may be employed to define an annular indentation in the flange of the closure and in the circumferential bead provided at the top of the side wall of the container body.

As seen in FIG. 4 of the drawings, the container 25 has seal means in the form of an adhesive sealing compound 43 which is provided between the closure and the bead 32 for the purpose of sealing the closure to the main container body 27 and such container 25 has an annular indentation designated generally by the reference numeral 44 in the flange 37 and bead 32 which cooperates with the sealing compound 43 to provide an improved seal between the closure 35 and the annular bead 32 and hence the container body 27.

Figure 5:
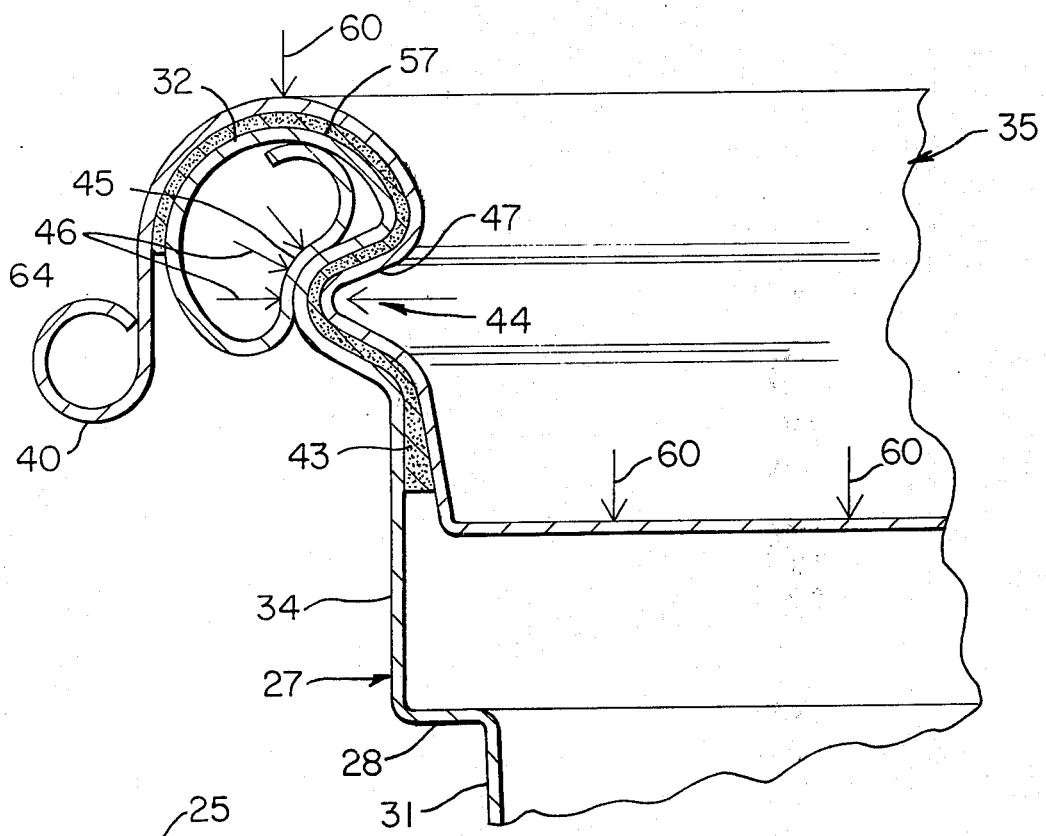
FIG. 5 is a greatly enlarged cross-sectional view similar to FIG. 4 and taken essentially on the line 5—5 of FIG. 1; and schematically illustrating, using arrows, the manner in which the improved seal is provided between the closure and the circumferential bead at the top of the side wall of the container body.

Referring now to FIG. 5, it will be seen that the annular indentation 44 positions the closure 35 on the container body 27 and simultaneously results in a deformation of an arcuate portion 45 of the bead 32 and such deformation is part plastic and part elastic. The part elastic deformation causes the arcuate portion 45 to be resiliently urged as shown schematically by force arrows at 46 in FIG. 5 whereby such arcuate portion is urged more tightly against the closure 35 and in particular the radially outwardly extending projection 47 of such closure 35 and the arcuate portion 45 cooperates with the sealing compound 43 to assure an improved seal between the closure 35 and the container body 27.

Figure 3:
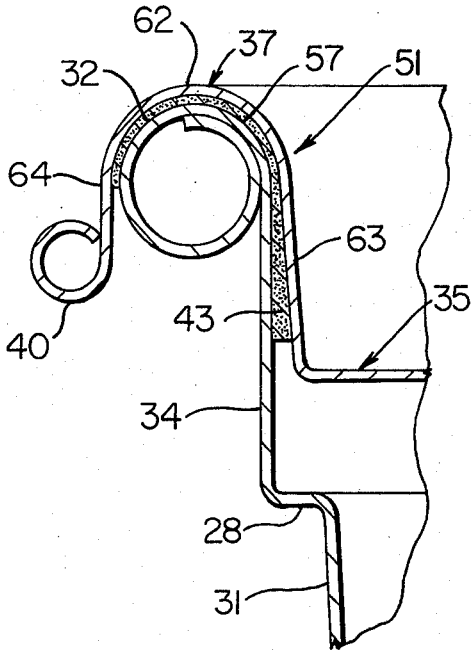
FIG. 3 is an enlarged cross-sectional view illustrating the closure in position against a first circumferential bead provided at the top of the side wall of the container body of FIG. 1 prior to providing an annular indentation in the flange of such closure and in such bead.
Figure 2:
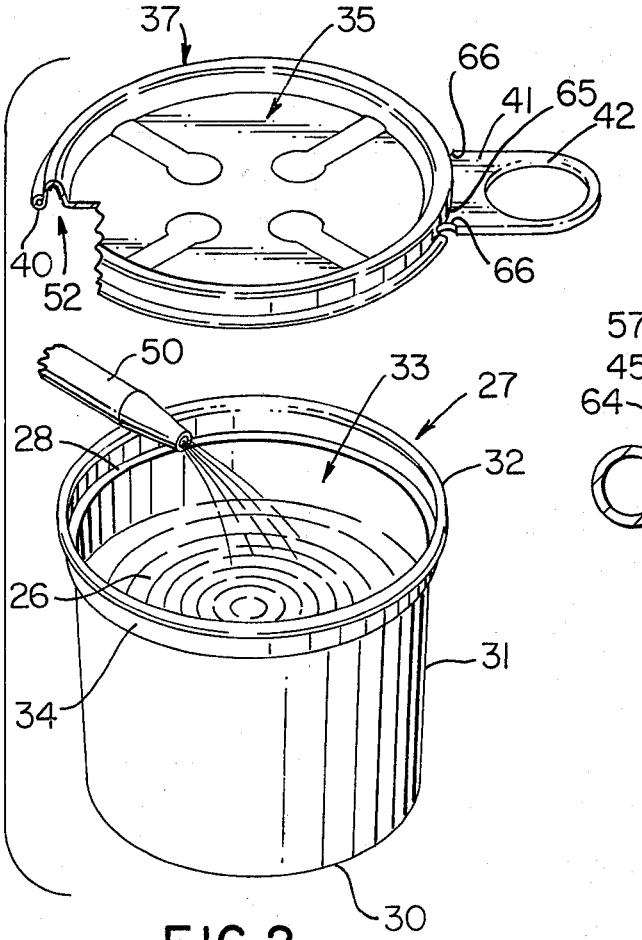
FIG. 2 is an exploded perspective view with certain parts broken away and others in cross section illustrating one way in which the container body of FIG. 1 may be filled with its product prior to sealing the closure thereon.

The container body 27 may be filled utilizing any technique known in the art and as illustrated in FIG. 2 of the drawings in this disclosure of the invention a filling nozzle 50 is provided for filling the container body with the product 26 whereupon after removal of the nozzle 50 the closure 35 is suitably placed in position in the manner illustrated at 51 in FIG. 3 with the sealing compound 43 provided between the closure 35 and bead 32. Although the compound may be initially applied against the closure 35, the bead 32 and adjoining portion of the side wall, or both closure and bead, in this disclosure of the invention such compound 43 is preferably applied as a coating against the inside surface of the flange 37 as illustrated at 52 in FIG. 2.

After the closure 35 is applied or placed in position, the indentation 44 is formed and any suitable means may be used for this purpose. However, in this example, a forming roller 53 is provided and rotatably supported on a shaft 54 while being urged by a suitable mechanism (not shown) against the closure 35 in the manner illustrated in FIG. 5 while backing the outside surface of the flange 37 with any suitable backing device or fixture which may be in the form of a rigid ring, whereby the forming roller 53 is moved around the entire inside periphery of the flange 37 while urging such roller outwardly to form the indentation 44.

Figure 6:
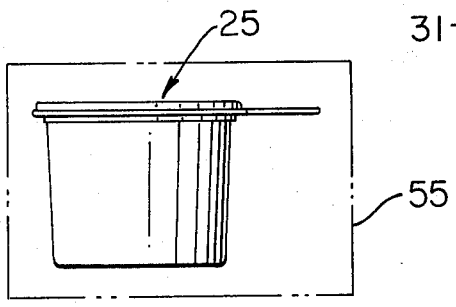
FIG. 6 is a schematic presentation of the container of FIGS. 1–5 after placement of the product therein and after forming the above-mentioned annular indentation as shown in FIG. 4 and illustrating such sealed container in an oven for the purpose of subjecting the product to a controlled elevated temperature.

After provision of the annular indentation 44, the container is then placed within a suitable processing device which in this example is shown by dot-dash lines in FIG. 6 as an oven 55 and the oven 55 may be of any suitable type and is controlled in temperature to assure preservation of the food product 26 within the container body 27. Once the product cools to normal ambient temperature a partial vacuum is produced inside the container 25 as is well known in the art.

The unique container 25 of this invention has a plurality of cooperating means and forces which provide an optimum seal between the container body 27 and the closure 35 as will be described in connection with FIG. 5. Accordingly, it will be seen that a first seal is provided by the adhesive compound 43 itself and such seal may be considered as including frictional contact between the outside surface 57 of the bead 32 and the inside surface of the compound 43. Another seal may be considered as being provided by the force resulting from the part elastic deformation indicated at 46 wherein the arcuate portion 45 of the bead 32 is resiliently urged more tightly against the closure and hence compound 43 of such closure. Still another seal may be considered as being provided by the force due to a partial vacuum within the container 25 wherein normal atmospheric pressure urges the closure 35 tightly against the main body portion 27 as indicated by the force arrows 60.

Referring now to FIGS. 3 and 4 of the drawings, it will be seen that the flange 37 of the closure 35 has a roughly U-shaped cross-sectional configuration defined by a roughly semicircular bight 62 having an inner leg portion 63 and an outer leg portion 64 with the leg portions 63 and 64 extending downwardly from opposite ends of the bight 62 in substantially parallel relation both prior to and after the formation of the indentation 44. The peripheral bead 40 is provided in the terminal end of the outer leg portion 64 and has a roughly circular cross sectional configuration whereby the bead 40 is also substantially toroidal.

The indentation 44 is in the form of a roughly V-shaped indentation as previously mentioned and such indentation is provided in the inner leg portion 63 and in the bead 32; and, it will be seen that the pull ring 41 extends from the outer leg portion 64 of the flange 37 as an integral part thereof and along an arcuate bend line 65 as shown in FIG. 2. A pair of metal stress relieving cutout openings 66 of roughly semicircular outline adjoin the inner edge of the pull ring 41 and leg portion 64 and separate the pull ring 41 from the remainder of the toroidal bead 40.

Figure 8:
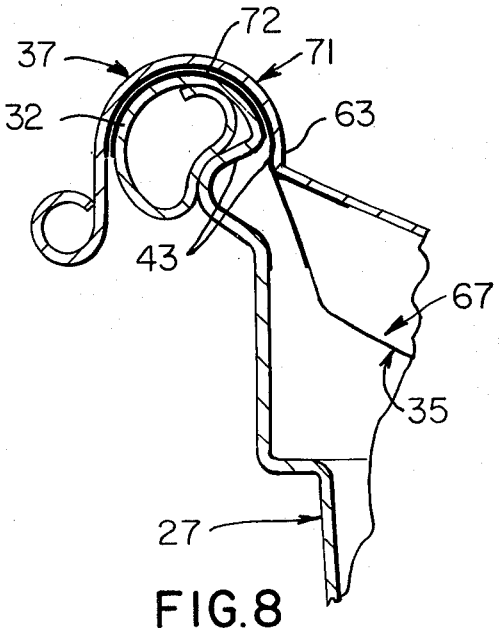
FIG. 8 is an enlarged cross-sectional view particularly illustrating the manner in which the inner leg portion of the closure flange is pulled away from the container body and the vacuum in the container released after having urged the central portion of the closure toward the center of the container body.
Figure 9:
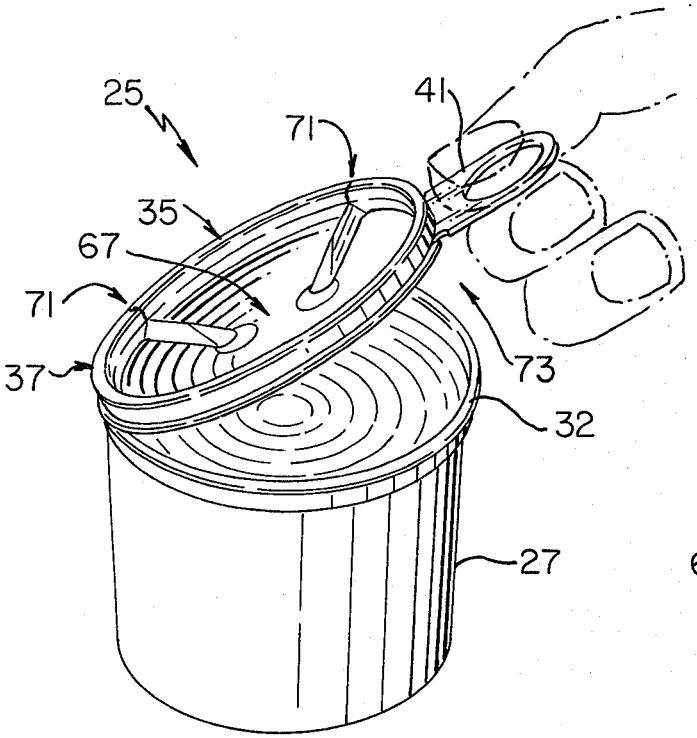
FIG. 9 is a perspective view illustrating the simple manner in which the container closure may be lifted away from the container body by lifting on a pull tab provided on the closure.
Figure 11:
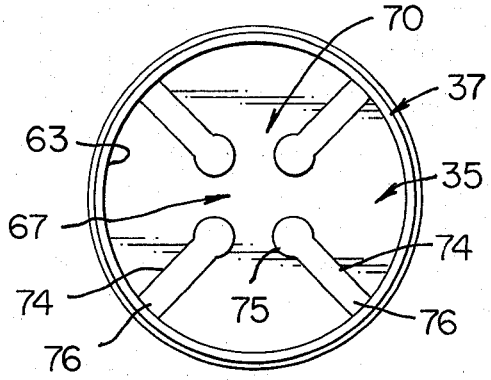
FIG. 11 is a top plan view of the closure of FIG. 10.

The closure 35 has a main body portion or main central portion as mentioned earlier and such portion is substantially planar and will be referred to hereinafter simply as a main portion and designated generally by the reference numeral 67; and, such main portion has integral force transmitting means therein which will be designated generally by the reference numeral 70. The force transmitting means is provided for the purpose of causing release of the inner leg portion 63 of the flange 37 away from the bead 32 upon urging the main body portion 67 toward the center of the container body 27 to enable removal of the closure 35 simply by lifting upwardly against the bead 40 upon urging the main portion 67 inwardly. The main portion 67 and hence the force transmitting means 70 may be urged inwardly utilizing a pair of thumbs, or the like, as illustrated by dot-dash lines in FIG. 7 whereby the inner leg portion 63 will be released from the bead 32 as illustrated at 71 in FIG. 8 causing a shearing of the adhesive 43. The inward urging of the main portion 67 also causes wrinkles or creases 71 in the flange 37 at various locations about its periphery and it has been found that such creases are generally produced at the terminal ends of force transmitting means 70. Each crease 71 provides further shearing or release of adhesive compound 43 from the bead 32 and flange 37 while also producing passages 72 which allow release of the vacuum from within the container 25 and such vacuum release is usually accompanied by the familiar hissing sound. Once this sound is heard not only has there been a vacuum release but the force transmitting means 70 has produced substantial release of the entire closure 35 from the container body 27 so that it may be simply lifted away by grasping the pull ring in a similar manner as illustrated at 73 in FIG. 9 and pulling the closure 35 away from the container body 27.

Figure 7:
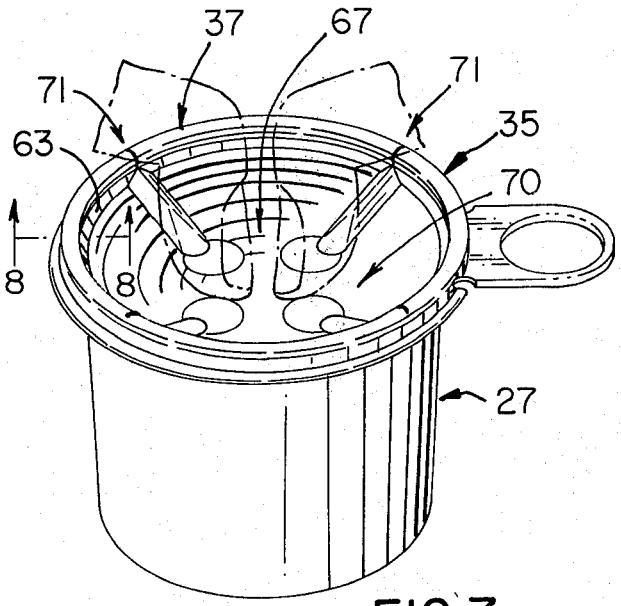
FIG. 7 is a perspective view illustrating integral force transmitting means in the central or main body portion of the closure being utilized to pull an inner leg portion of the peripheral flange of such closure away from the peripheral bead of the container body by urging against the force transmitting means by means shown in dot-dash lines as a consumer's thumbs.
Figure 10:
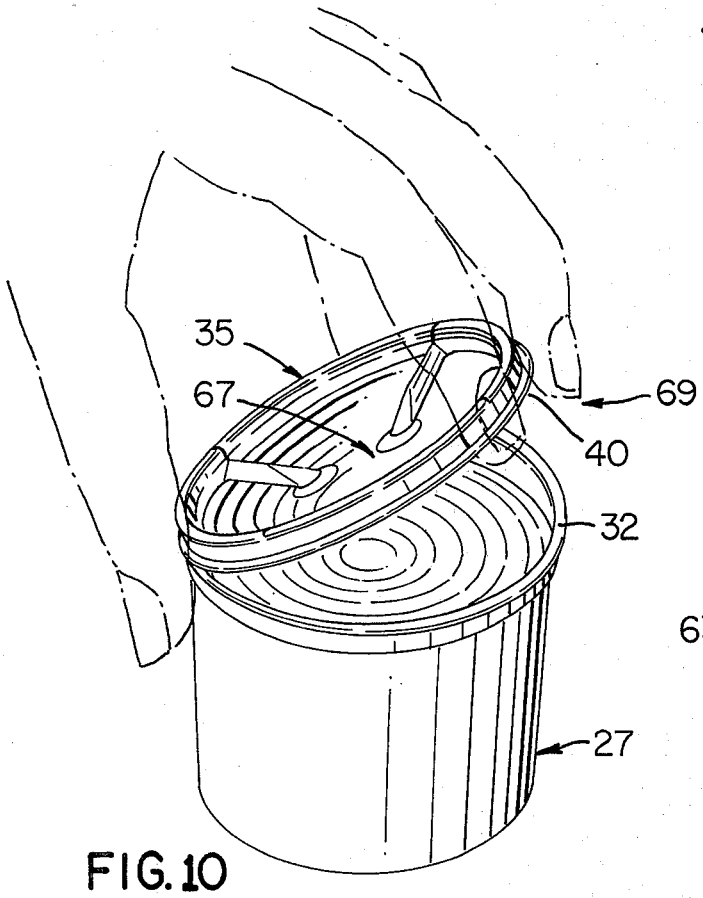
FIG. 10 is a view similar to FIG. 9 which illustrates a modification of a closure which is identical to the closure of FIG. 9 with the exception that it does not have a pull tab and such closure is simply removed from the container body by lifting such closure away therefrom in the manner illustrated in FIG. 10.

It will be appreciated that the closure 35 need not necessarily be provided with a pull ring 41 and indeed such pull ring may be eliminated as illustrated in FIG. 10 whereupon the closure of FIG. 10 is also designated generally by the reference numeral 35 and may be grasped by simply grasping peripheral edges thereof beneath the peripheral flange 40 and lifting upwardly as illustrated at 69 with the lifting action being achieved after pushing or urging the main portion 67 inwardly in a similar manner as illustrated in FIG. 7 of the drawings. The closure 35 of FIG. 10, being substantially identical to the previously described closure 35 with the pull ring 41, is installed in position in the manner described in detail above in connection with FIGS. 1–6 and removal of this closure is achieved essentially as described in connection with FIGS. 7, 8, and 10. Further, the force transmitting means 70 in the closure 35 is the same regardless of whether the pull ring is provided or not and a detailed description will now be made of such force transmitting means 70 in connection with FIGS. 2, 9, 10 and 11 of the drawings.

The force transmitting means 70 is provided as an integral part of the main portion 67 of the closure 35 and such force transmitting means comprises a plurality of raised portions 74 provided as an integral part of the main portion 67. The raised portions 74 are in the form of a plurality of four keyhole-shaped portions arranged 90 degrees apart with each having a bulbous end 75 arranged closely adjacent to the center of the main portion 67 and an end 76 opposite the bulbous end which adjoins the inner leg portion 63 of the flange 37.

Other exemplary embodiments of closures of this invention are illustrated in FIGS. 12–20. The embodiments of closures illustrated in FIGS. 12, 13, 14, 15, 16, 17, 18, 19, and 20 are similar to the closure 35 of FIG. 11, and are also provided without pull devices or the like; therefore, such closures will be designated by the reference numerals 35A, 35B, 35C, 35D, 35E, 35F, 35G, 35H, and 35I respectively and component parts of each closure 35A-35I which are similar to the closure 35 will be designated in the drawing by the same reference numeral as in the closure 35 (whether or not such component parts are mentioned in the specification) followed by an associated letter designation of A, B, C, D, E, F, G, H, or I and not described again in detail. Only those component parts of each closure 35A–35I which are quite different from the closure 35 will be given a new reference numeral also followed by the associated letter designation and described in more detail.

The closures 35A–35I have been illustrated without a pull device, or the like, however, such closures may be provided with a pull device substantially identical to the pull device or ring 41 previously described and shown in the drawings or any other suitable device. In addition, each closure 35A–35I has force transmitting means 70A–70I, to be subsequently described. Each of these force transmitting means is provided as an integral part of its associated closure and is defined by one or more raised portions (raised portions in this context meaning being raised relative to a plane which may be considered a main plane within which key parts of the central part of the closure lie) having substantially the same wall thickness as the remainder of its closure, namely substantially the same wall thickness as the main portion and peripheral flange thereof.

Figure 12:
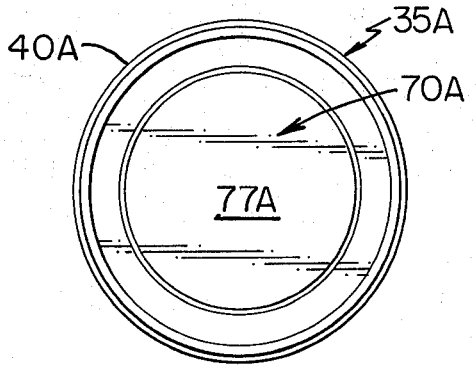
FIGS. 12–20 are top plan views of closures which are identical to the closure of FIG. 11 with the exception that each of the closures of FIGS. 12–20 has a different force transmitting means provided as an integral part of its main central portion.

The closure 35A of FIG. 12 has force transmitting means 70A in the form of a circular central raised portion 77A arranged concentrically with the bead 40A of such closure and such raised portion is raised outwardly away from the center of the associated container once the closure 35A is installed in position.

Figure 13:
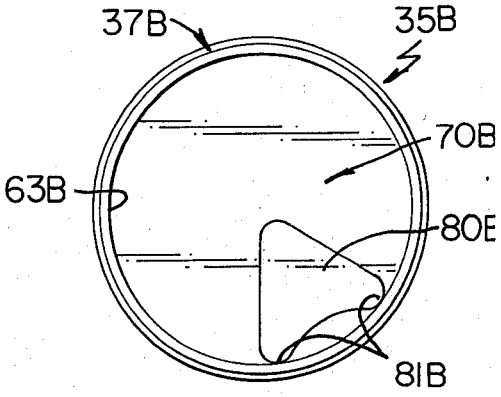

The closure 35B of FIG. 13 has force transmitting means 70B therein in the form of a triangular raised portion 80B which is in the form of an isosceles triangle having its apex arranged closely adjacent the center of the closure 35B and having a base provided with an arcuate central part and rounded ends 81B arranged adjacent the inner leg portion 63B of the flange 37B.

Figure 14:
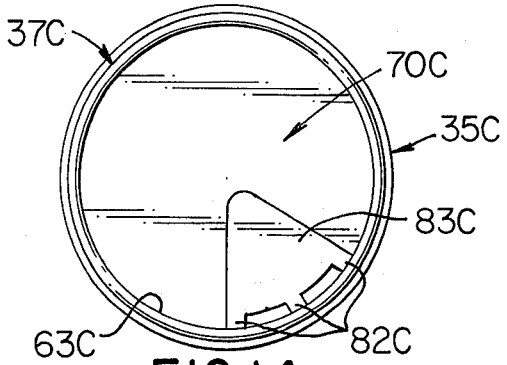

The force transmitting means 70C of the closure 35C of FIG. 14 comprises a plurality of three raised portions 82C at the terminal edge of a roughly triangular raised portion 83C which has an apex adjacent the center of the closure and the three raised portions 82C adjoin the inner leg portion 63C of the flange 37C.

Figure 15:
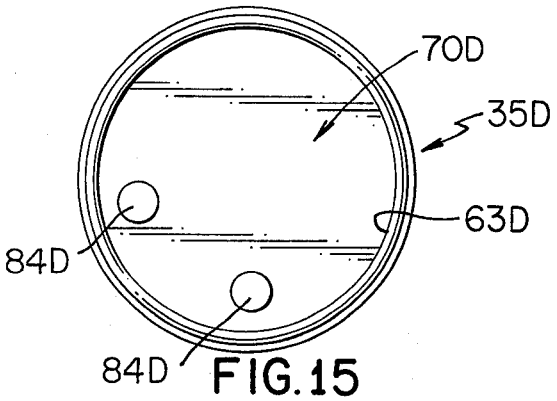

The closure 35D of FIG. 15 has force transmitting means 70B in the form of a plurality of raised portions shown as a plurality of two outwardly convex portions 84D of circular peripheral outline with the outwardly convex portions 84D being arranged adjacent the inner leg portion 63D of the flange 37D.

Figure 16:
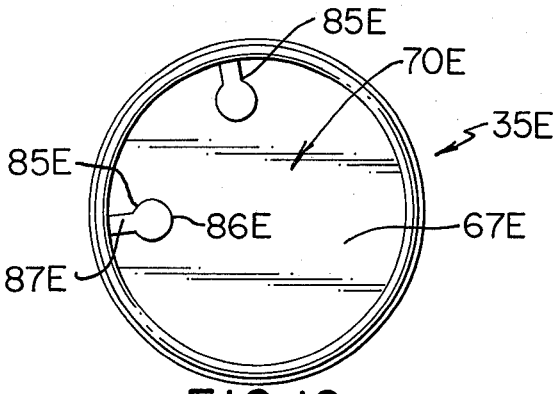

The closure 35E of FIG. 16 has force transmitting means 70E therein in the form of a plurality of two raised portions comprised of a plurality of two keyhole-shaped raised portions 85E arranged approximately 90° apart with each of the keyhole shaped portions having a bulbous end which has an area greater than the remainder 87E of such keyhole-shaped portion and each bulbous end 86E is arranged adjacent the center of the main body portion 67E.

Figure 17:
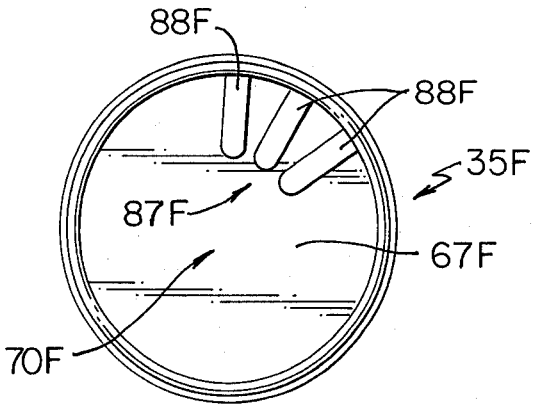

The closure 35F of FIG. 17 has force transmitting means 70F in the form of a set 87F of three elongated raised portions 88F provided within a 90 degree sector of the main portion 67F of the closure. The three raised portions 88F have their longitudinal axes extending toward the center of the main body portion 67F in a converging manner.

Figure 18:
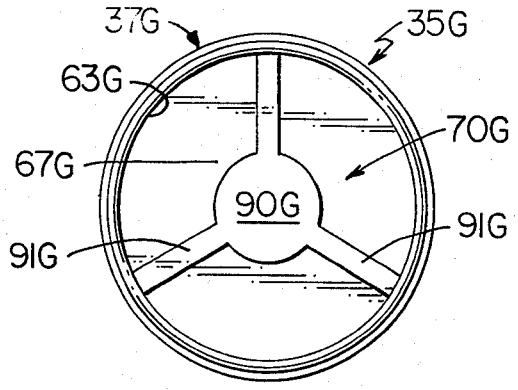

The closure 35G of FIG. 18 has force transmitting means 70G therein in the form of a plurality of raised portions comprising a raised disc-like central part 90G provided at the center of the main portion 67G and a plurality of three radially extending parts 91G having terminal ends which adjoin the inner leg 63G of the peripheral flange 37G of closure 35G.

Figure 19:
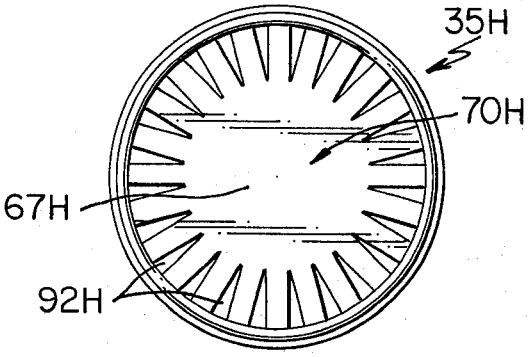

The closure 35H of FIG. 19 has force transmitting means 70H therein in the form of a plurality of raised portions 92H which extend about the entire periphery of the main portion 67H of such closure, and the plurality of raised portions 92H are substantially triangular portions having apexes pointing generally toward the center of the main body portion 67H.

Figure 20:
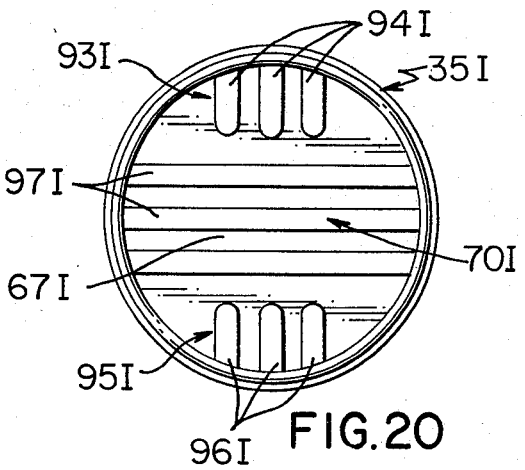

The closure 35I of FIG. 20 has force transmitting means 70I therein comprising a set 93I of three elongated parallel raised portions each designated by the reference numeral 94I with the set 93I being arranged within a 90° sector of the main body portion 67I and with the raised portions 94I extending toward the center of the main portion 67I. The force transmitting means 70I includes another set 95I of three elongated parallel raised portions 96I arranged substantially diametrically opposite the set 93I; and, the force transmitting means 70I also includes a plurality of raised portions each designated by the reference numeral 97I extending the full width of the circular closure while being arranged between and perpendicular to the sets 93I and 95I of raised portions 94I and 96I respectively.

Each of the force transmitting means 70 and 70A–70I is provided in its associated closure and in each instance is comprised of one or more raised portions and each force transmitting means if brought into action by pressing inwardly against the main body of the closure. In each instance an appropriate instruction is provided on the closure by ink, raised or recessed letters provided by embossing action, or other suitable marking means stating, in essence, "PRESS HERE UNTIL VACUUM RELEASE THEN LIFT LID". The vacuum release with its hissing sound is well known and as explained earlier results in eliminating the sealing action provided by atmospheric pressure; and, the inward urging against the main body of the closure also results in the elimination of other sealing action as explained previously. The above instruction has not been shown on the various embodiments of the closures illustrated in the drawings for simplicity and to avoid confusion which might result if too much information were to be provided on the various views of the drawings.

The various raised portions comprising the force transmitting means of the closures 35 and 35A–35I are shown as raised portions which have been raised outwardly. However, such raised portions may be provided by being raised inwardly toward the center of the associated container in what might be considered a recessed manner. However, regardless of whether such raised portions are raised inwardly or outwardly such raised portions are raised only a small fractional part of the height of the inner leg portion of the associated closure. In particular, such fractional height may be about one tenth the height of the inner leg portion of the associated closure flange.

Any suitable material may be used to make the container of this invention; however, the container body and closure are preferably made of a metallic material preferably in the form of an aluminous material. For example, for a five ounce container used to contain desserts, or the like, the closure may be made of 3003 H-14 or 5005 H-14 aluminum alloy 0.006 inch thick. The container body may be made of 5050 H-19 or 3003 H-19 aluminum alloy 0.0075 inch thick.

Reference has been made in this disclosure to the provision of a container of roughly 5 ounce size for desserts, or the like. However, it is to be understood that the container of this invention may be as small as a fraction of an ounce or much greater than 5 ounces and may be used to contain any desired product.

In this disclosure of the invention the container body and closure in each instance is shown as having a generally circular outline. However, it is to be understood that the concept of this invention is fully applicable to the containers having container bodies and closures of cooperating non-circular peripheral outlines such as oblong, rectangular, and the like.

The container body and closure of each container of this invention is preferably coated on its inside and outside surfaces with a suitable protective coating which may be a modified vinyl base coating such as a modified polyvinyl cloride film. For example, in one application of this invention where 5 ounce containers were used to contain desserts a polyvinyl cloride film coating of 8.5 milligram per square inch was provided on the inside surface of the container body and closure and a 2 milligram per square inch coating was provided on the outside surface of these components. It will also be appreciated that the coating on the inside and outside surfaces may be any suitable thermoset coating, or the like.

Any suitable material may be used to define the sealing compound 43 and preferably a compound similar to the type used on an ordinary beverage container may be provided. A typical compound which may be used is produced by Dewey Almey Division of W. R. Grace Co., and sold under the trade designation of Dewey Almey Compound 1108.

while present exemplary embodiments of this invention, and methods of practicing the same, have been illustrated and described, it will be recognized that this invention may be otherwise variously embodied and practiced within the scope of the following claims.

What is claimed is:

1. A container comprising, a metallic container body adapted to contain a product therein and having a bottom wall and a side wall terminating in a first deformable circumferential bead of substantially tubular toroidal form defining an open end in said container body, a deformable metallic closure for said container body, said closure having a main portion adjoined at its outer edge by an annular flange, said flange terminating in a second circumferential bead, force transmitting means provided as an integral part of said main portion, seal means between said closure and first bead, and an annular indentation in said flange and first bead which cooperates with said seal means to provide an improved seal between said closure and said first annular bead, said flange having a roughly U-shaped cross-sectional configuration defined by a bight having an inner leg portion and an outer leg portion with said leg portions extending downwardly from opposite ends of said bight and said annular indentation being in the form of a roughly V-shaped indentation in said inner leg portion and in said first bead, said annular indentation positions said closure on said container body and simultaneously results in a deformation of a portion of said first bead which is a part plastic deformation and a part elastic deformation, said part elastic deformation causing said portion of said first bead to be resiliently urged more tighly against said closure, said resiliently urged portion cooperating with said seal means to provide said improved seal, said force transmitting means causing release of said inner leg portion of said flange away from said first bead by shearing said seal means upon urging and permanently deforming at least part of said main body portion toward the center of said container body enabling removal of said closure simply by lifting upwardly against said second bead.

2. A container as set forth in claim 1 in which said force transmitting means comprises a central raised portion arranged concentrically with said second bead.

3. A container as set forth in claim 1 in which said force transmitting means comprises a plurality of raised portions in said main portion of said closure, said raised portions having the same wall thickness as the remainder of said closure.

4. A container as set forth in claim 3 in which said plurality of raised portions comprises a plurality of key-hole shaped portions arranged 90° apart with each of said key-hole shaped portions having a bulbous end arranged closely adjacent to the center of said main portion.

5. A container as set forth in claim 3 in which said plurality of raised portions comprises a plurality of outwardly convex portions of circular peripheral outline.

6. A container as set forth in claim 3 in which said plurality of raised portions comprises a plurality of three portions at the terminal edge of a roughly triangular raised portion, said triangular raised portion having an apex adjacent the center of said closure and said three projections adjoining an inner side thereof which adjoins said inner leg portion of said flange.

7. A container as set forth in claim 3 in which said plurality of raised portions comprises a set of three elongated parallel raised portions provided within a 90° sector of said main portion, said set of three raised portions extending toward the center of said main portion.

8. A container as set forth in claim 7 and further comprising another set of three elongated parallel raised portions arranged substantially diametrically opposite said first-named set of three raised portions.

9. A container as set forth in claim 8 and further comprising a plurality of raised portions extending the full width of said closure while being arranged perpendicular to said sets.

10. A container as set forth in claim 3 in which said plurality of raised portions comprises a plurality of raised portions which extend about the entire periphery of said main portion of said closure in substantially equal angularly spaced relation.

11. A container as set forth in claim 10 in which said plurality of raised portions comprises a plurality of substantially triangular portions having apexes pointing toward the center of said main portion.

12. A container as set forth in claim 3 in which said plurality of raised portions comprises a raised disc-like circular part provided at the center of said main portion and a plurality of radially extending parts extending from said circular part and having terminal ends which adjoin said inner leg of said peripheral flange of said closure.

13. A container as set forth in claim 3 in which said plurality of raised portions comprises a plurality of three raised portions having longitudinal axes which extend toward the center of the main body portion in a substantially converging manner.

14. A container as set forth in claim 3 in which said plurality of raised portions comprises a plurality of two key-hole shaped raised portions arranged approximately 90° apart with each of the key-hole shaped portions being arranged adjacent the center of the main body portion.

15. A container as set forth in claim 3 in which said container body and closure are made of a metallic material containing aluminum.

* * * * *